United States Patent [19]

Pozniak et al.

[11] Patent Number: 4,901,681

[45] Date of Patent: Feb. 20, 1990

[54] MOTION ISOLATED ENGINE MANIFOLD

[75] Inventors: Donald J. Pozniak, Utica; Carl L. Friebel, Troy, both of Mich.

[73] Assignee: General Motors Corporation, Detroit, Mich.

[21] Appl. No.: 236,963

[22] Filed: Aug. 26, 1988

[51] Int. Cl.[4] ..... F02B 75/18

[52] U.S. Cl. ..... 123/52 MV; 277/181; 285/49

[58] Field of Search ..... 123/52 M, 52 MV; 138/120; 277/181, 186, 188 R, 235 B, 235 R; 285/49, 189

[56] References Cited

U.S. PATENT DOCUMENTS

| | | | |
|---|---|---|---|
| 3,520,284 | 7/1970 | Ruoff et al. | 123/52 MV |
| 4,191,140 | 3/1980 | Matsumoto et al. | 123/52 MB |
| 4,372,120 | 2/1983 | Ford, Jr. et al. | 123/52 MV |
| 4,428,331 | 1/1984 | Zang et al. | 123/52 MV |
| 4,470,378 | 9/1984 | Malik et al. | 123/52 M |

FOREIGN PATENT DOCUMENTS

| | | | |
|---|---|---|---|
| 830272 | 2/1952 | Fed. Rep. of Germany | 285/49 |
| 1343717 | 10/1963 | France . | |

*Primary Examiner*—Noah P. Kamen
*Attorney, Agent, or Firm*—Robert J. Outland

[57] ABSTRACT

An intake manifold assembly for a V-type engine utilizes separate flange members that are resiliently connected to a manifold body through adherently secured resilient vibration absorbing isolators. The flanges and isolators combine with the body to define sealed resilient fluid conducting joints that provide the sole support for and resiliently isolate at least the adjacent portions of the manifold body. They also provide for connection of the manifold to the engine using conventional non-isolating connecting bolts or fastening means which are easily applied and removed and limit the number of special separate parts required at assembly.

16 Claims, 2 Drawing Sheets

MOTION ISOLATED ENGINE MANIFOLD

TECHNICAL FIELD

This invention relates to motion isolated engine manifolds, means for isolating such manifolds and to engines, especially of the V type, equipped with such manifolds. More particularly, the invention involves a V-type engine with an isolated intake manifold having joint isolating means and supports.

BACKGROUND

It is known in the art to provide an engine intake manifold which is resiliently mounted on an engine to provide vibration and noise isolation of the manifold from the cylinder bank or banks as well as, in V-type engines, to allow relative motion of the banks and the manifold. However, the prior art fails to disclose an isolated manifold assembly which is removably mountable on an engine using conventional non-isolated mounting means.

SUMMARY OF THE INVENTION

The present invention provides an intake manifold assembly which utilizes separate flange members that are resiliently connected to a manifold body through adherently secured resilient vibration absorbing isolators. The flanges and isolators combine with the body to define sealed resilient fluid conducting joints that provide the sole support for at least the adjacent portions of the manifold body. They also provide for connection of the manifold to the engine using conventional non-isolating connecting bolts or fastening means which are easily applied and removed and limit the number of special separate parts required at assembly.

The isolators and flanges may be adherently secured to each other and the body, either through use of an added adhesive in known manner or by molding the elements together for mechanically adherent retention. In the latter case, resilient sealing beads may be provided on the mounting faces of the flanges as part of the molding process.

In a V-type engine installation, the manifold assembly reduces temperature induced stresses by allowing, within the capability of the resilient joints, movement of the cylinder banks relative to one another and the manifold. Such movement may be caused by temperature variations occurring in normal use. If desired, an assembly with an offset plenum may be additionally supported by the engine at the overhung end, or at other locations distant from the resilient joints, by isolating studs or other isolation mounting means.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
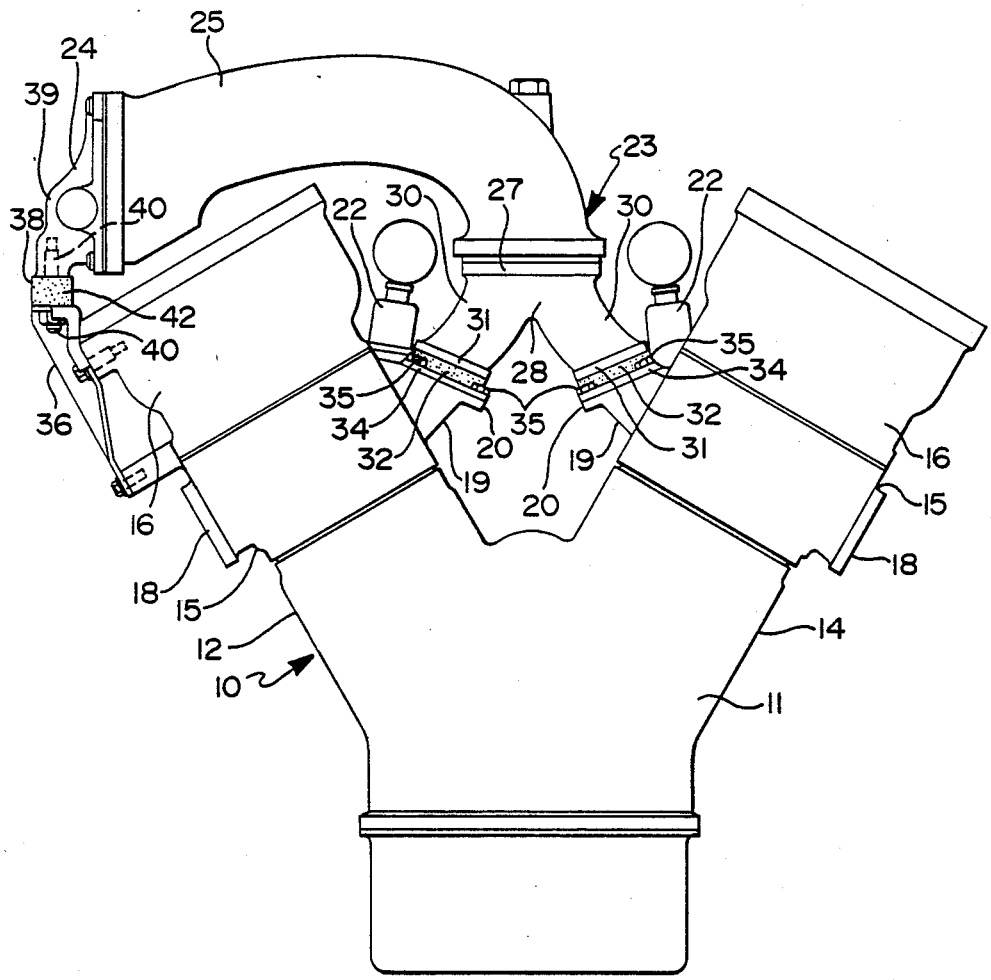
FIG. 1 is an end view of a V-type internal combustion engine having an inlet manifold assembly formed in accordance with the invention.

Referring now to the drawings in detail, numeral 10 generally indicates a V-type internal combustion engine having the usual cylinder block 11 with a pair of angularly disposed cylinder banks 12, 14. Each cylinder bank carries a cylinder head 15 on which there is mounted a valve cover or cam cover 16.

The cylinder heads 15 are provided on their outer sides with exhaust mounting bosses 18 for mounting exhaust manifolds, not shown. On the inner sides of the heads 15, facing the open V between the cylinder banks, are port extensions 19 having sloped upwardly facing intake mounting bosses 20. Adjacent the bosses 20, means are provided for receiving fuel injectors 22. These are positioned on the cylinder heads for delivering fuel charges to intake ports, not shown, that pass through the extensions 19 and open through the intake bosses 20.

Carried on the mounting bosses 20 is an intake manifold assembly generally indicated by numeral 23. The multipiece manifold assembly 23 includes a plenum cover 24, an upper section 25 defining a plenum (not shown) and a plurality of intake runners 26 extending from the plenum, and a base section 27 defining extensions of the intake runners 26 and support means to be described.

The base section 27 includes a bifurcated body 28 having longitudinally aligned groups or pairs of oppositely angled legs 30, only two of which are shown. The legs 30 define the runners 26 and connect downwardly with two support flanges 31, one for each set of aligned legs. Of course, more or fewer flanges could be used if desired.

To each support flange 31, there is adherently attached a resilient isolator 32 made of suitable rubber-like material that is capable of sealing, supporting and resiliently isolating the manifold. On the other side of each isolator from the associated support flange 31, a mounting flange 34 is adherently attached.

The mounting flange 34, resilient isolator 32 and support flange 31 on each side of the manifold cooperate in defining extensions of the internal runners, or passages, 26 that extend from the plenum in the upper section 25, through the base section 27 and open through the bottom of the mounting flange 34.

Figure 2:
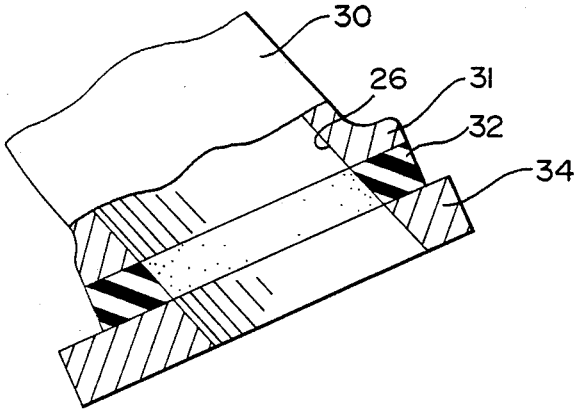
FIG. 2 is an enlarged view partially in cross section of one of the mounting portions of the manifold of FIG. 1.

In the assembled condition of FIG. 1, the mounting flanges 34 of the manifold are secured to the intake mounting bosses 20 by conventional non-isolated fasteners, such as bolts 35, so that the runner passages 26 are connected with the engine intake ports, not shown. In the embodiment of FIGS. 1 and 2, separate gaskets, not shown, are normally provided to seal the joints between the mounting flanges 34 and the bosses 20.

In the case of a centrally mounted manifold, centered above the legs 30 and evenly supported on the bosses 20, it would be possible to support the manifold 23 solely through the resilient isolators 32. In such a case, the isolators would provide for complete isolation of the manifold from the block and head assembly.

In the illustrated embodiments, however, the manifold upper section 25 extends over one bank 12 of cylinders and to one side of the central supporting means including the isolators 32. Because of the substantial overhung mass existing with this arrangement, it is desireable to provide additional support means for the cover 24 and outer end of the upper section 25.

As shown in FIG. 1, this is accomplished through a bracket 36 which is mounted on the cam cover 16 under the manifold upper section 25. The bracket 36 is secured to and supports an isolator stud 38 which, in turn, threadably engages and supports a boss 39 on the cover 24. Two or more isolator studs may be used if desired. The isolator studs may each comprise a pair of separate aligned studs 40 having adjacent ends molded into a resilient isolator body 42.

Any suitable means may be used to adhesively bond the isolators 32 to their respective flanges 31, 34. One method considered particularly suitable at present is to use an epoxy adhesive to provide a hardened high quality bond. Such a method is described, for example in U.S. patent application Ser. No. 197,948 filed May 24, 1988 and assigned to the assignee of the present invention.

Figure 3:
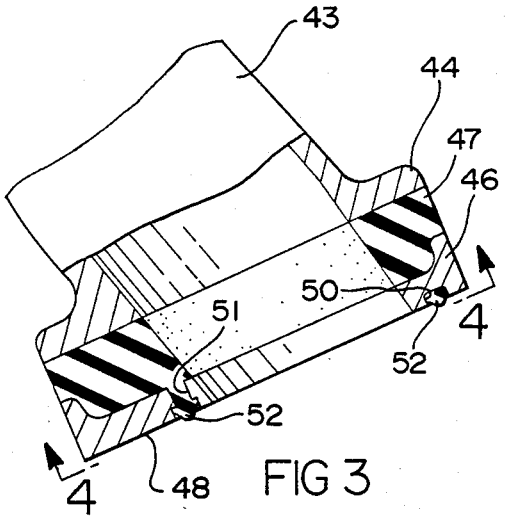
FIG. 3 is a view similar to FIG. 2 but illustrating an alternative embodiment.
Figure 4:
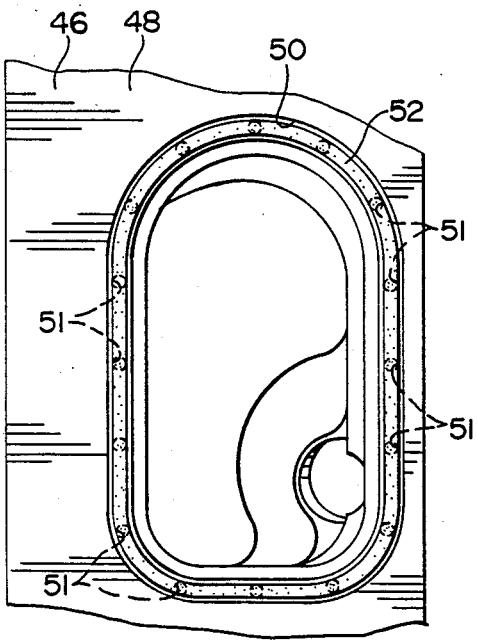
FIG. 4 is an end view of a mounting leg of the alternative embodiment from the plane of the line 4—4 of FIG. 3.

Alternatively, the isolators may be adherently secured to their flanges by other means such as by molding the isolators in position between their flanges. Such an arrangement is shown in FIGS. 3 and 4, wherein the manifold legs 43 have support flanges 44 and mounting flanges 46, between which the resilient isolators 47 are molded to form the assembled base.

In this embodiment, the mounting face 48 of each flange 46 is provided with a groove 50 which is connected by openings 51 with the other side of the flange to which the isolator is molded. In the molding operation, part of the resilient material is directed through the openings 51 into the groove 50 where it is formed into a sealing bead 52. The bead 52 extends below the level of the mounting face 48 and is compressed upon installation of the manifold to act as a seal, thereby avoiding the need for a separate gasket. Although not shown, it should be apparent that the mounting flanges 46 are provided with fastener openings for receiving attaching bolts or the like in the same manner as the flanges 34 of the embodiment of FIGS. 1 and 2.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

We claim:

1. An engine inlet manifold having a main body, a mounting flange and a resilient isolator adherently secured to spaced opposed surfaces of the body and the flange and defining therewith a fluid passage sealed by the isolator at the joint between the surfaces, the flange including means for securing the flange solidly to a ported engine component and the isolator being operative to allow limited relative motion between the flange and the main body while supporting the body on the flange.

2. A manifold as in claim 1 wherein the isolator is secured to the main body and the flange by molding.

3. A manifold as in claim 1 wherein the isolator is secured to the flange by molding and the mounting surface of the flange has a sealing bead also molded thereon.

4. A manifold as in claim 3 wherein the sealing bead is seated in a groove on the flange mounting surface and is formed during the molding of the isolator to the flange.

5. A manifold as in claim 4 wherein the bead is integrally connected with the isolator through openings in the flange extending between the sealing surface and the groove and filled during the molding of the isolator and bead.

6. A manifold as in claim 3 wherein the isolator is secured to the main body by an adhesive material.

7. A manifold as in claim 1 wherein the isolator is secured to the main body and the flange by an adhesive material.

8. In combination in a V-type engine having a pair of angularly disposed cylinder banks extending from a common crankcase and defining an intermediate valley, an engine inlet manifold secured to and connecting with both said cylinder banks to carry charging air from a common supply to cylinders in said cylinder banks, said manifold having a main body, a pair of mounting flanges and a pair of resilient isolators, one adherently secured to spaced opposed surfaces of each flange and the body and defining therewith a fluid passage sealed by the isolator at the joints between the surfaces, each flange including means for securing the flange solidly to a respective one of the cylinder banks and the isolators being operative to allow limited relative motion between the cylinder banks and the manifold main body while supporting the main body on the engine.

9. A combination as in claim 8 wherein the manifold main body extends to one side of the engine and has a plenum portion that overhangs one of the cylinder banks, wherein the combination further includes support means including supplemental resilient isolators supporting the plenum portion on said one of the cylinder banks.

10. An engine inlet manifold component having a body, a pair of mounting flanges and a pair of resilient isolators, one adherently secured to spaced opposed surfaces of each flange and the body and defining therewith a fluid passage sealed by the isolator at the joints between the surfaces, each flange including means for securing the flange solidly to a respective ported engine component, and the isolators being operative to allow limited relative motion between the flanges and the body while supporting the body on the flanges.

11. A manifold component as in claim 10 wherein the isolators are secured to the body and the flanges by molding.

12. A manifold component as in claim 10 wherein the isolators are secured to the flanges by molding and the mounting surface of each flange has a sealing bead also molded thereon.

13. A manifold component as in claim 12 wherein each sealing bead is seated in a groove on its respective flange mounting surface and is formed during the molding of the respective isolator to the flange.

14. A manifold component as in claim 13 wherein each bead is integrally connected with its isolator through openings in the respective flange extending between the sealing surface and the groove and filled during molding of the respective isolator and bead.

15. A manifold component as in claim 12 wherein each isolator is secured to the body by an adhesive material.

16. A manifold component as in claim 10 wherein each isolator is secured to the body by an adhesive material.

* * * * *